US005623912A

United States Patent [19]

Kelly

[11] Patent Number: 5,623,912

[45] Date of Patent: Apr. 29, 1997

[54] IGNITION CONTROL CIRCUIT, AND ENGINE SYSTEM

[75] Inventor: Brendan P. Kelly, Stockport, England

[73] Assignee: U.S. Philips Corporation, New York, N.Y.

[21] Appl. No.: 576,551

[22] Filed: Dec. 21, 1995

[30] Foreign Application Priority Data

Dec. 23, 1994 [GB] United Kingdom ..... 9426214
Jul. 25, 1995 [GB] United Kingdom ..... 9515272

[51] Int. Cl.[6] ..... F02P 3/12

[52] U.S. Cl. ..... 123/644

[58] Field of Search ..... 123/644, 643, 123/620; 364/431.04; 324/388

[56] References Cited

U.S. PATENT DOCUMENTS

| | | | |
|---|---|---|---|
| 4,167,928 | 9/1979 | Pagel | 123/148 |
| 4,660,534 | 4/1987 | Cotignoli | 123/643 |
| 5,033,445 | 7/1991 | Kobayashi et al. | 123/644 |
| 5,058,021 | 10/1991 | Scott | 364/431.04 |
| 5,115,793 | 5/1992 | Giaccardi et al. | 123/620 |
| 5,140,970 | 8/1992 | Akaki et al. | 123/620 |
| 5,284,124 | 2/1994 | Moriyama et al. | 123/643 |
| 5,294,887 | 3/1994 | Etzold | 324/388 |
| 5,373,826 | 12/1994 | Taruya et al. | 123/634 |

*Primary Examiner*—Raymond A. Nelli
*Attorney, Agent, or Firm*—Robert J. Kraus

[57] ABSTRACT

A respective power semiconductor switch (M1, M2, M3) is provided for each ignition coil (20) of an internal combustion engine. Each such switch (M1, M2, M3) has a first main electrode (C) for coupling the primary winding (20*a*) of the associated ignition coil (20) to a first voltage supply line (1), and a control electrode (G) coupled to an respective ignition control line (Ign1, Ign2, Ign3) for rendering these switches (M1, M2, M3) conducting in a given sequence. A further semiconductor device (M4) has first and second main electrodes (d and s) coupled between second main electrodes (E) of the power semiconductor switches (M1, M2, M3) and a second voltage supply line (2), and a control electrode (g) for a drive signal controlling the current flow through the device (M4). A current sensing arrangement (Rs) senses the current flowing through this further device (M4). A control device (30) common to the switches (M1, M2, M3) of the coils (20) controls the drive signal to the control electrode (g) of the further device (M4) to limit the current through this further device (M4) to a predetermined value and then to turn off this further device (M4) so as to render a conducting one of the switches (M1, M2, M3) non-conducting to initiate sparking in the cylinder associated with that one switch. Sophisticated logic and control functions can be integrated with the common control device (30). The complex impedance of the ignition coil (20) can be isolated readily from the control loop of the further device (M4) and control device (30) by the switches (M1, M2, . . . ) operating in cascade with the further device (M4).

11 Claims, 3 Drawing Sheets

IGNITION CONTROL CIRCUIT, AND ENGINE SYSTEM

BACKGROUND OF THE INVENTION

This invention relates to an ignition control circuit for an internal combustion engine for automotive and like applications. The invention also relates to an engine system comprising an internal combustion engine with at least two ignition coils and having such an ignition control circuit. The ignition control circuit in accordance with the invention may comprise a separate power semiconductor switch for each ignition coil, and a further circuit device common to all the power semiconductor switches.

Traditional ignition control circuits have a single ignition coil controlled by a contact breaker and ballast circuit arrangement and coupled to a 1 to 4 or 1 to 6 (depending on whether the internal combustion engine has four or six cylinders) high tension distributor to enable the combustion cycles of the individual cylinders to be controlled in the desired sequence to enable correct operation of the internal combustion engine. Such an arrangement requires a number of mechanically complex moving components such as the contact breaker and distributor and it can be difficult to ensure that the timing sequence of the firing of the cylinders remains accurate, especially over long periods.

In recent years electronic ignition systems have been introduced into automobiles. In this case, complex mechanical parts are replaced with solid state components that allow microprocessor or computer control so enabling more precise control of the operation of the internal combustion engine. In order to avoid the need for a distributor, it has recently been proposed to provide a number of ignition coils so that, at most, two cylinders share a common ignition coil and to provide a separate solid state switching and current limiting circuit for each ignition coil to replace the contact breaker and ballast of a conventional internal combustion engine.

Each such switching and current limiting circuit typically requires a power semiconductor switch and a complex control circuit. Generally these have to be provided as separate components and cannot be integrated together without the use of very complex and thus costly buried layer semiconductor isolation techniques, because inherent parasitic bipolar structures within the integrated circuit may cause detrimental and even irreversible breakdown at the high voltages experienced in internal combustion engine ignition control systems. Such problems are especially likely to arise where the power semiconductor devices used are Insulated Gate Bipolar Transistors (IGBTs). As is well known to those skilled in the art of power semiconductor switches, IGBTs basically have a power MOSFET structure but are provided with an anode region to inject opposite conductivity type carriers (holes in the case of an n-channel MOS structure) into the drain drift region of the MOS structure to reduce the on-resistance of the power semiconductor switch. The use of IGBTs is advantageous because an IGBT can achieve a lower on-state voltage drop for a given voltage rated device than the corresponding power MOSFET (IGFET).

SUMMARY OF THE INVENTION

According to one aspect of the present invention, there is provided an ignition control circuit for an internal combustion engine having at least two ignition coils each having a primary and a secondary winding and each ignition coil being associated with at most two cylinders, the ignition control circuit comprising a respective power semiconductor switch for each ignition coil, each power semiconductor switch having a first main electrode for coupling via the primary winding of the associated ignition coil to a first voltage supply line, a second main electrode and a control electrode coupled to a respective ignition control line for enabling the power semiconductor switches to be rendered conducting in a given sequence, a further semiconductor device having first and second main electrodes coupled between the second main electrodes of the power semiconductor switches and a second voltage supply line and a control electrode for receiving a drive signal for controlling the current flow through the further semiconductor device, means for sensing the current flowing through the further semiconductor device and a control device common to the power semiconductor switches and responsive to the sensed current for controlling the signal to the control electrode of the further semiconductor device for limiting the current through the further semiconductor device to a predetermined value and responsive to an input signal for turning off the further semiconductor device to render a conducting one of the power semiconductor switches non-conducting to initiate sparking in any cylinder associated with the one power semiconductor switch.

According to another aspect of the present invention, there is provided an engine system comprising an internal combustion engine having at least two ignition coils each having a primary and a secondary winding, each ignition coil being associated with at most two cylinders of the engine, and an ignition control circuit comprising a respective power semiconductor switch for each ignition coil, each power semiconductor switch having a first main electrode coupled via the primary winding of the associated ignition coil to a first voltage supply line, a second main electrode and a control electrode coupled to a respective ignition control line for enabling the power semiconductor switches to be rendered conducting in a given sequence, and wherein the ignition control circuit also comprises a further semiconductor device having first and second main electrodes coupled between the second main electrodes of the power semiconductor switches and a second voltage supply line and a control electrode for receiving a drive signal controlling the current flow through the further semiconductor device, means for sensing the current flowing through the further semiconductor device, and a control device common to the power semiconductor switches and responsive to the sensed current for controlling the signal to the control electrode of the further semiconductor device for limiting the current through the further semiconductor device to a predetermined value and responsive to an input signal for turning off the further semiconductor device to render a conducting one of the power semiconductor switches non-conducting to initiate sparking in a cylinder associated with the one power semiconductor switch.

Thus, an ignition circuit in accordance with the invention avoids the need for a distributor and enables a single control device to be used for controlling current limiting and firing of the cylinders of the internal combustion engine, so reducing the overall number of components required to produce the circuit and therefore reducing the overall cost of the circuit. The further semiconductor device need only be a low voltage, typically a 30 to 60 volt rated device. Even a 10 volt rated device could be acceptable in some circuit configurations. This allows the further semiconductor device to be integrated with the control device, so even further reducing the overall number of separate components required. This common integrated device may also comprise logic functions for determining and controlling various features of the ignition sequence, for example the adaptive dwell time, the spark dwell time, and whether or not there is a valid spark.

Furthermore, when the further semiconductor device and a power semiconductor switch of an ignition control circuit in accordance with the invention are operating as a cascade with the further semiconductor device drawing only a predetermined current from the power semiconductor switch, the true complex impedance of the ignition coil is isolated from the control device-further semiconductor device loop by the power semiconductor switch voltage follower. It is therefore easier to make a stable closed loop current source than if the further semiconductor device were directly connected to the ignition coil.

The further semiconductor device may comprise an insulated gate field effect transistor (IGFET) coupled in a cascade configuration with each of the power semiconductor switches.

Each power semiconductor switch may comprise an Insulated Gate Bipolar Transistor (IGBT). The use of IGBTs is advantageous because an IGBT has a lower on-resistance than the equivalent size power MOSFET. However, the IGBTs could be replaced with larger size power MOSFETs, or with even power bipolar transistors if an appropriate base drive arrangement is provided. Each IGBT is generally provided with a voltage clamping arrangement for limiting the voltage between the control electrode and the first and second main electrodes of the insulated gate bipolar transistor. The voltage clamping arrangement may comprise film thin semiconductor diodes formed on top of and isolated from the IGBT so enabling the voltage clamping arrangement to be integrated with the IGBT while avoiding the possibility of the clamping diodes introducing further parasitic bipolar problems which might happen if diffused diodes were used.

The current sensing means may comprise a sense resistor coupled between the further semiconductor device and the second voltage supply line. Such an arrangement should be relatively easy to implement. Of course, other forms of current sensing means may be used, for example the further semiconductor device may be provided with a sense electrode for deriving a proportion of the current flowing through sense cells of the further semiconductor device in a manner similar to that described in, for example, EP-B-0139998 or EP-A-0595404. It may also be possible to provide the separate power semiconductor switches with sense cells and to sense the current directly from the current flowing through sense electrodes of the power semiconductor switches. Where IGBTs are used as the power semiconductor switches, this may require the sense cells to be different from the remaining cells of the IGBT, that is the emitters of the sense cells may be omitted as described in, for example, U.S. Pat. No. 4,980,740.

The control device may comprise a differential amplifier for comparing a voltage derived from the sensing means with a reference voltage.

Each ignition line is generally coupled to the control electrode of the associated power semiconductor switch via a resistive coupling device. Each ignition line is generally coupled to the control electrode of the further semiconductor device by a rectifying coupling device. Each resistive or rectifying coupling device may comprise at least one diode.

BRIEF DESCRIPTION OF THE DRAWING

Embodiments of the present invention will now be described, by way of example, with reference to the accompanying drawing, in which.

It should of course be understood that the drawing figures are not to scale and that like reference numerals are used throughout the text to refer to like parts.

DESCRIPTION OF THE PREFERRED EMBODIMENTS

Figure 1:
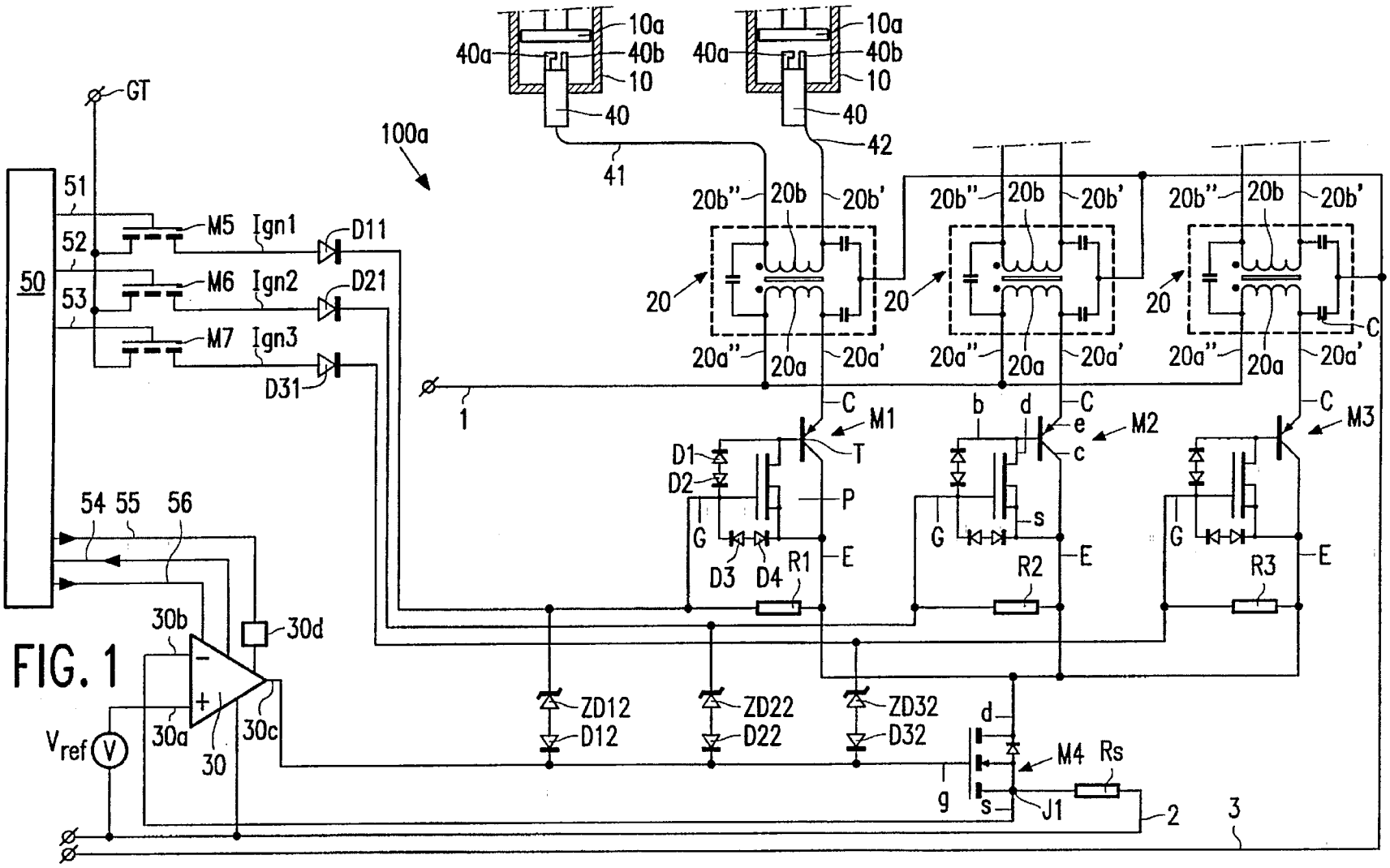
FIG. 1 shows a circuit diagram of one example of an ignition control circuit and engine system, both in accordance with the invention.

Referring now to the drawings, there are illustrated circuit diagrams of ignition control circuits 100*a*, 100*b* and 100*c* for a four stroke internal combustion engine having at least four cylinders 10. Only one (or more) of its cylinders 10 is partly and very schematically shown in FIGS. 1 to 3. The complete internal combustion engine which may be of known type is not shown. Associated with these cylinders 10 are at least two ignition coils 20 each having a primary winding 20*a* and a secondary winding 20*b*. The ignition control circuits 100*a* and 100*b* each comprise a respective power semiconductor switch (M1, M2 and M3 in FIG. 1 and M1, M2, M3 and M9 in FIG. 2) for each ignition coil 20. Each power semiconductor switch M1, M2, M3, M9 has a first main electrode C for coupling via the primary winding 20*a* of the associated ignition coil 20 to a first voltage supply line 1, a second main electrode E, and a control electrode G coupled to an respective ignition control line Ign1, Ign2, Ign3 for enabling the power semiconductor switches M1, M2, M3 to be rendered conducting in a given sequence. A further semiconductor device M4 has first and second main electrodes d and s coupled between the second main electrodes E of the power semiconductor switches M1, M2, M3 and a second voltage supply line 2 and a control electrode g for receiving a drive signal for controlling the current flow through the further semiconductor device M4. Each circuit 100*a*, 100*b* and 100*c* also comprises means Rs for sensing the current flowing through its further semiconductor device M4, and a control device 30 common to its power semiconductor switches M1, M2, M3 and responsive to the sensed current Is for controlling the signal to the control electrode g of the further semiconductor device M4 for limiting the current through the further semiconductor device M4 to a predetermined value and responsive to an input signal (via 30*d*) for turning off the further semiconductor device M4 to render a conducting one of the power semiconductor switches M1, M2, M3 non-conducting to initiate sparking in any cylinder 10 associated with that one power semiconductor switch.

Thus, an ignition circuit 100 in accordance with the invention avoids the need for a distributor and enables a single control device 30 to be used for controlling current limiting and firing of the cylinders 20 of the internal combustion engine, so reducing the overall number of components required to produce the circuit and therefore reducing the overall cost of the circuit. Moreover, because the further semiconductor device M4 need only be a low voltage device (typically a 30 to 60 volt rated device, or even perhaps a 10 volt rated device), the further semiconductor device M4 may be integrated with the control device 30, so even further reducing the overall number of separate components required.

Furthermore, when the further semiconductor device M4 and a power semiconductor switch M1, M2, M3, M9 of an ignition control circuit in accordance with the invention are operating as a cascade with the further semiconductor device M4 drawing only a predetermined current from the power semiconductor switch M1, M2, M3, M9 the true complex impedance of the ignition coil 20 is isolated from the loop 30, M4 (of the control device 30 and further semiconductor device M4) by the power semiconductor switch M1, M2, M3 voltage follower. It is therefore easier to make a stable closed loop current source than if the further semiconductor device M4 were directly connected to the ignition coil 20.

Referring now specifically to FIG. 1, each power semiconductor switch M1, M2, M3 comprises an Insulated Gate Bipolar Transistor (IGBT). Each insulated gate bipolar transistor M1, M2, M3 is generally provided with a voltage clamping arrangement for limiting the voltage between the control electrode G and the first and second main electrodes C and E of the insulated gate bipolar transistor M1, M2, M3. The voltage clamping arrangement may comprise back-to-back film thin semiconductor diodes formed on top of and isolated from the IGBT, so enabling the voltage clamping arrangement to be integrated with the IGBT while avoiding the possibility of the clamping diodes introducing further parasitic bipolar problems which might happen if diffused diodes were used. An IGBT having such a voltage clamping arrangement is described in EP-A-0566179. The voltage clamping diodes need not necessarily be provided in the location described in EP-A-0566179 but may be provided at any suitable location on top of (and electrically isolated from) the IGBT structure.

For the sake of convenience and to illustrate the MOS and bipolar nature of the IGBT, (although the IGBT is of course a single device) each IGBT is shown in FIG. 1 as a pnp bipolar transistor P in combination with an n-channel MOS transistor T with the emitter electrode e of the bipolar transistor P forming the first main electrode C of the IGBT, the base electrode b of the bipolar transistor B being coupled to the drain electrode d of the MOS transistor T, and the source electrode s of the MOS transistor T being coupled to the collector electrode c of the bipolar transistor P to form the second main electrode E of the IGBT. The gate electrode of the MOS transistor T forms the control or gate electrode G of the IGBT.

The voltage clamping arrangement of each IGBT is shown schematically in FIG. 1 as back-to-back diodes D1 and D2 coupled between the first main and control electrodes C and G of the IGBT and back-to-back diodes D3 and D4 coupled between the second main and control electrodes E and G of the IGBT. Of course, the actual number of diodes D1 to D4 used will depend on their particular break down characteristics and the desired maximum voltage (clamping voltage) between the first main and control electrodes C and G and between the second main and control electrodes E and G of the IGBT. Typically, the clamping voltages may be 350 to 400 volts.

As indicated above, the first main electrode C of each IGBT M1, M2, M3 is coupled to one terminal 20*a*' of the primary winding 20*a* of the associated ignition coil 20. The other terminal 20*a*" of the primary winding 20*a* is coupled to a first voltage supply line 1 which will generally be the positive terminal of the battery in an automobile and thus will generally, assuming normal operation of the battery, be at 12 volts.

The actual construction of an automotive four stroke internal combustion engine is conventional and very well known to those skilled in the art of internal combustion engines and automobiles and therefore will not be described in detail. However, in the interests of clarity and for ease of explanation, FIG. 1 does shows very diagrammatically parts of two cylinders 10. Each cylinder 10 is closed at one end and receives a close-fitting piston rod, the head 10*a* of which is shown in FIG. 1. Although not shown in FIG. 1, the piston rod is generally attached by a connecting rod to a crankshaft which converts the reciprocating motion of the piston into rotary motion. The crankshaft is provided with a crankpin for each connecting rod so that the power from each cylinder is applied to the crankshaft at the appropriate point in its rotation. Vaporized or atomised fuel is supplied from a carburettor or fuel injection system to each cylinder 10 through an intake manifold and exhausted through an exhaust manifold by means of valves controlled by the automobile engine management unit in known manner.

Although, only three IGBTs M1, M2 and M3 are shown in FIG. 1, it will, of course, be appreciated that the number of IGBTs required will depend upon the number of ignition coils 20 which will in turn depend upon the number of cylinders that the internal combustion engine has. In any four stroke engine with an even number of in-line cylinders, the natural outcome of minimising vibration and improving torque flatness is that, when one piston is nearing the top of its compression stroke, another piston is nearing the top of its exhaust stroke. In such circumstances, it is convenient, as shown in FIG. 1, for one ignition coil 20 to be associated with two cylinders 10 because the spark generated by the coil during an exhaust stroke will be of no consequence. Such an arrangement has been used for many years in motorcycles where reduced weight, operation at high RPM (revs per minute) and maximum high tension (HT) circuit reliability under damp exposed conditions are important. Such a two cylinder per coil arrangement is also now becoming common in cars or automobiles, because the richer fuel-to-air mixtures required for exhaust catalyst equipped engines require a higher performance ignition system than traditional carburettor equipped engines. Higher performance ignition systems can also improve the efficiency and emissions performance of internal combustion engines.

It will, of course, be appreciated that, although FIG. 1 shows only parts of two cylinders 10, each coil 20 will be associated with two cylinders 10, and accordingly the arrangement shown in FIG. 1 is intended for use with a six cylinder internal combustion engine. Where the internal combustion engine has four cylinders, then only two ignition coils 20 and associated power semiconductor switches M1, M2 would be required.

As indicated above, in FIG. 1, each ignition coil 20 is associated with two cylinders. As shown schematically in FIG. 1, the secondary winding 20*b* of each ignition coil 20 has two terminals 20*b*' and 20*b*" for providing positive and negative, respectively, high tension (voltage) outputs coupled to respective high tension spark plug leads 41 and 42. An outer electrode 40*a* of a spark plug 40 received in one of the two cylinders 10 associated with a coil 20 is coupled to the positive high tension spark plug lead 41. The outer electrode 40*a* of a spark plug 40 received in the other of the two cylinders 10 associated with a coil is coupled to the negative high tension spark plug lead 42. As is conventional, the central electrode 40*b* of each spark plug 40 is coupled to a suitable ground potential by, for example, being grounded to the cylinder head, engine or vehicle ground. The spacing of the electrodes 40*a* and 40*b* of each spark plug 40 define the spark gap across which a spark is produced at the appropriate point in the combustion cycle by the ignition control circuit 100*a* (in the manner which will be described below) to ignite the fuel within the cylinder.

The terminals 20*a*' and 20*b*' of each ignition coil 20 are capacitively coupled together and to a chassis ground line 3. The terminals 20*a*" and 20*b*" of each ignition coil 20 are similarly capacitively coupled together.

In the example shown, the further semiconductor device M4 comprises an n-channel insulated gate field effect transistor (IGFET) coupled in a cascade configuration with each of the power semiconductor switches M1, M2, M3. Thus, the first main electrode d of the IGFET M4 is coupled to all of the second main electrodes E of the power semiconductor switches M1, M2, M3, while the second main electrode s of the IGFET M4 is coupled to the second voltage supply line 2 which is usually connected to a suitable ground potential (such as the automobile body) via, for example, the wiring loom.

As indicated above, a cascade arrangement enables isolation of the power semiconductor switches M1, M2, M3 to be provided in a relatively simple manner and should allow for simpler compensation and better stability. Thus, when the IGFET M4 and an IGBT M1, M2, M3 are operating as a cascade with the IGFET M4 drawing only a predetermined current from the IGBT, the true complex impedance of the ignition coil 20 is isolated from the control device 30-IGFET M4 loop by the IGBT voltage follower. It is therefore easier to make a stable closed loop current source than if the IGFET M4 were directly connected to the ignition coil 20.

In the example shown in FIG. 1, the current sensing means comprises a sense resistor Rs coupled between the IGFET M4 and the second voltage supply line 2. Such an arrangement should be relatively easy to implement. The insulated gate or control electrode g of the IGFET M4 is coupled to the output 30*c* of a predriver which forms the common control device 30.

This predriver 30 is effectively a comparator or closed loop operational amplifier and has positive input 30*a* coupled via a reference voltage source Vref to the second voltage supply line 2. The reference voltage source Vref may be, for example, provided by a down band gap reference of, for example, 320 mV (millivolts) with respect to the lower voltage end of the sense resistor Rs and internally derived. The negative input 30*b* of the predriver 30 is coupled to a junction J1 between the sense resistor Rs and the second main electrode s of the IGFET M4. A disabling circuit (shown as a block 30*d*) is integrated with the amplifier for overriding the functioning of the operational amplifier and pulling its output 30*c* low in response to a control signal. Any suitable form of disabling means 30*d* may be used, for example an simple open collector bipolar transistor and resistor arrangement, where the operational amplifier is formed using bipolar technology.

The control or gate electrode G of each IGBT M1, M2, M3 is coupled to a respective ignition line Ign1, Ign2, Ign3 via a respective resistive (generally rectifying) device D11, D21, D31. In the example shown, each resistive device D11, D21 and D31 comprises a diode having its cathode coupled to the control electrode G of the associated IGBT. The diodes D11, D21 and D31 are provided to allow the built-in over-voltage clamping of the associated IGBT M1, M2 and M3 to function when required by pulling the insulated gate or control electrode G of the IGBT high. As another possibility, resistors could be used in place of the diodes D11, D21 and D31.

Each ignition line Ign1, Ign2, Ign3 is generally also coupled to the control electrode g of the further semiconductor device M4 by a further rectifying device. Each further rectifying device may comprise a zener diode ZD12, ZD22, ZD32 coupled in anti-series (that is back-to-back) with an associated diode D12, D22, D32 to prevent forward conduction of the zener diodes ZD12, ZD22 and ZD32. These further rectifying devices are provided to allow the associated IGBT M1, M2 or M3 to bring the further semiconductor device M4 into conduction when the over-voltage clamping arrangement of that IGBT is active. If, however, the predriver 30 is provided with a coil voltage feedback arrangement, then the zener diodes ZD12, ZD22 and ZD32 and associated diodes D12, D22 and D32 may be omitted and the predriver 30 may be used to turn on the further semiconductor device M4 if any one of the coils 20 exhibits an excessive voltage.

The diodes D11, D21, D31, D12, D22 and D32 and zener diodes ZD12, ZD22 and ZD32 may, for example, be formed as diffused diodes of any suitable type (for example pn junction or Schottky diodes) and may be integrated with the same semiconductor body as the further semiconductor device M4 or may be formed as thin-film pn junction diodes, such as polycrystalline silicon diodes, and integrated on top of an insulating layer provided over the semiconductor body. The use of this thin-film diode technology has the advantage of avoiding introducing any additional parasitic bipolar problems in integrating the diodes.

A respective high value (typically 10 KΩ, i.e KiloOhm) resistor R1, R2, R3 is coupled between the gate and second main electrodes G and E of each IGBT M1, M2, M3 to turn off the IGBT M1, M2 or M3 when the drain electrode d of the IGFET M4 and the associated ignition line Ign1, Ign2, Ign3, or an over-voltage, are not trying to turn the IGBT on. A lower value of resistance for these resistors R1, R2, R3 may be desirable to reduce turn off delays but, of course, the signals supplied by the ignition lines Ign1, Ign2, Ign3 must be able to overcome these resistances.

The ignition control circuit 100*a* is itself controlled by the engine management system which may be a conventional computer or microprocessor engine control unit (ECU) and is indicated schematically in FIG. 1 by the block 50. Any suitable ECU may be used, for example the SBEC-III produced by the Chrysler Corporation.

The ECU 50 controls the coupling of a gate or control voltage terminal GT to the ignition lines Ign1 to Ign3 using any suitable means. As shown in FIG. 1, the gate terminal GT is coupled to one main electrode of each of three control transistors M5 to M7 which may be p-channel IGFETs. The other main electrode of each of the IGFETs M5 to M7 is coupled to a respective one of ignition lines Ign1 to Ign3. The gate or control electrode of each of the IGFETs M5 to M7 is coupled to a respective clocking signal or control output 51 to 53 of the ECU 50 so that the control electrodes G of the IGBTs M1 to M3 can be coupled to the gate terminal GT in the required sequence and at the correct time. The gate terminal GT is coupled to an appropriate voltage supply which may be a 5 volt logic supply. The IGFETs M5 to M7 may not be necessary if the outputs 51 to 53 are of sufficiently low impedance and provide a sufficiently high voltage output. This may be achievable even with a 5 volt supply if so-called logic-level IGBTs and MOSFET are used, i.e if the IGBTs M1, M2, M3 and the IGFET M4 require only a gate voltage equivalent to that of a logic device, and the diodes D11, D21, D31 are Schottky diodes. In such circumstances, the diodes D11, D21 and D31 may be coupled directly to the outputs 51 to 53.

The ECU 50 also supplies control signals and receives status signals from the predriver 30 as indicated very schematically in FIG. 1 by the lines 54, 55 and 56. The status line 54 may be provided to enable an indication that current limiting is occurring to be supplied to the ECU 50 to assist the ECU 50 in controlling the timing of the combustion cycle, for example to allow adaptive dwell. This status line may be coupled to suitable conventional circuitry within the predriver which provides an output signal when the voltage sensed across the sense resistor Rs equals the reference voltage Vref. The timing control line 55 is, as shown in FIG. 1, coupled to the disabling or overriding circuit 30*d* to provide a signal, when appropriate, to override the operation of the differential amplifier and pull low its output. A further control line 56 may be coupled from the ECU 50 to a conventional voltage divider arrangement within the predriver 30 to allow the ECU 50 to adjust the reference voltage Vref and so to adjust the current level at which current limiting occurs. Of course, other more flexible forms of communication and control between the predriver 30 and the ECU 50 such as serial bi-directional communication, for example $I^2C$, may be used. Another arrangement will be described later with reference to FIG. 3.

The operation of the ignition control circuit 100*a* shown in FIG. 1 will now be explained for one combustion cycle for one cylinder 10 associated with the IGBT M1.

First the ECU 50 renders the control IGFET M4 conducting to supply the gate drive voltage to the ignition line Ign1. This occurs before or at the same time as the timing control input 55 to the predriver 30 indicates that the on or dwell time of the associate primary winding 20*a* circuit should begin. Initially the predriver 30 fully turns on the IGFET M4, which pulls the second main electrode E of all the IGBTs M1 to M3 towards the voltage of the second voltage supply line 2, generally ground. The IGBT M1 coupled by its ignition line Ign1 to the gate voltage at the gate terminal GT is also fully turned on, and so almost the full voltage at the first voltage supply line 1 (that is the battery voltage) is applied to the primary winding 20*a* of the ignition coil 20 associated with the IGBT M1.

The voltage across the primary winding 20*a* of the selected ignition coil 20 causes the current through the primary winding 20*a* to rise in that ignition coil. The rise rate is given by $di/dt=\epsilon/L$, where $\epsilon$ is the potential across the coil or inductor winding and L is the inductance of, in this case, the primary winding plus leakage inductance (because the secondary winding sees almost an open circuit until the associated spark plug breaks over). All the other IGBTs (M2 and M3 in the example shown) are off, i.e non-conducting, because their control or gate electrodes G are isolated from the gate drive signal and are not driven high.

The predriver 30 compares the voltage at the junction J1 with that supplied by the reference voltage source Vref and starts to reduce the gate drive to the IGFET M4 once the sensed current Is starts to reach a predetermined or programmed value. This causes the conduction of the IGFET M4 to start to fall, and at the control or current limiting point the IGFET M4 drain voltage rises, until the IGBT M1 starts to function as a voltage follower which presents a more or less fixed voltage to the drain electrode d of the IGFET M4 and which draws from the ignition coil 20 whatever current is drawn from its second main electrode E by the IGFET M4. Thus, the predriver 30 varies the control of the IGFET M4 to regulate the current through the IGBT M1 and the ignition coil 20.

At this stage, the IGBT M1 and IGFET M4 are operating as a cascade, with the IGFET M4 drawing only the predetermined current from the second main electrode E of the IGBT M1. The true complex impedance of the load (i.e the impedance of ignition coil 20 primary winding circuit 20*a*, so long as the coil primary winding 20*a* voltage is high enough that the IGBT M1 voltage follower presents a low-impedance almost fixed voltage to the drain electrode d of the IGFET M4) is isolated from the predriver 30-IGFET M4 control loop by the IGBT M1 voltage follower. It is therefore easier to make a stable closed loop current source than if the IGFET M4 were directly connected to the ignition coil 20.

The predriver 30 maintains a current limiting condition until the timing signal supplied to the predriver 30 on line 55 by the ECU 50 indicates that the dwell or on period for the primary winding 20*a* of the selected ignition coil 20 is over. The disabling or overriding circuit 30*d* then causes the predriver 30 to attempt to turn off the IGFET M4 by supplying a low signal at its output 30*a*. Thus, the start and end of conduction of the IGFET M4 are determined by the rising and falling of the logical input to the predriver 30 on the control line 55. The IGFET M4 thus then attempts to turn off the IGBT M1 by blocking current from the second main electrode of the IGBT M1. The associated ignition coil 20 generates a positive fly back voltage at the first main electrode C of the IGBT M1 in response to the attempt to decrease the current. Normally the energy of the ignition coil 20 will be dissipated by the high tension circuit that allows secondary winding current to flow through the secondary winding 20*b* of the ignition coil 20 (and thus to the spark plugs 40 coupled to that coil 20) in place of the primary winding current. This causes a spark to be generated across the electrodes 40*a* and 40*b* to ignite fuel in the one of the two cylinders 10 coupled to that coil 20 that is on its compression stroke to push the piston downwardly to start the firing stroke of the piston. As indicated above, in the circuit shown in FIG. 1, each ignition coil 20 is associated with two combustion cylinders 10. Their associated spark plugs 40 with the two associated cylinders are arranged so that one is on its first or firing or expansion stroke while the other is on its fourth or exhaust stroke. Thus, a spark is also generated in the other of the two cylinders 10 coupled to that coil 20, but it has little or no effect because that other cylinder is on its exhaust stroke. The rate of rise of voltages is limited by stray and ignition-coil self-capacitances at the secondary winding and the capacitance C shown connected to the primary winding.

The diodes ZD12 to ZD32 are provided for over-voltage clamping in case the high tension (voltage) spark plug leads 41 and 42 become disconnected. If leads 41 and 42 become disconnected, the fly back energy of the ignition coil 20 cannot be absorbed by the spark (and lead resistance) but instead must be absorbed by safely clamping the primary winding 20*a* to about 400 volts above ground (with a corresponding effect of clamping the open circuit secondary winding 20*b* to around 40 kV(Kilo Volts)). The clamping of the secondary winding 20*b* prevents damage due to tracking if there is no high tension spark plug lead coupled to the ignition coil 20. Tracking involves arcing across contaminants on the surface of, for example, parts of the coil assembly that may produce conductive carbon deposits which can form conductive tracks rendering the high tension component useless. Normally, however, the spark plug 40 would act as an effective clamp at much lower secondary winding 20*b* voltages (and hence primary winding 20*a* voltages).

The diodes ZD12 to ZD32 act to ensure that, when the clamping diodes D1 to D4 of an IGBT M1, M2 or M3 conduct to limit an excessive voltage (over-voltage), the control or gate electrode of the IGFET M4 can be turned on to dissipate the over-voltage. The diodes ZD12 to ZD32 will act in this manner even if the predriver 30 has just turned the IGFET M4 off, for example when high voltage ring-off occurs when the predriver 30 attempts to turn off the current to a primary winding 20*a*. Without these components the IGFET M4 may go into avalanche under these conditions and the clamped voltage would then be determined by the avalanching of the diode D1 and the forward voltage Vf of the diode D2 of the IGBT and the threshold and the avalanche voltages of the IGFET M4. If off-the-shelf or standard IGBTs are used (with an at least 30 volt rated IGFET M4 that may avalanche at 40 volts), then a clamped voltage determined by the clamping diodes of the IGBT and the threshold and the avalanche voltages of the IGFET M4 would be too high and may not adequately protect the secondary winding 20*b* of the ignition coil. Another reason for actively turning on the IGFET M4 is that it avoids avalanche within the IGFET M4 and reduces the dissipation within the IGFET M4.

At or shortly after the end of the dwell period the ECU 50 renders the IGFET M5 non-conducting, so removing the gate drive signal from the ignition line Ign1. The above-described cycle is then repeated for each ignition line or channel Ign1 to Ign3 in turn so that the combustion cycles of the cylinders occur repeatedly in a sequence and with a timing determined by the ECU.

Thus, as can be seen from the above, the ignition lines Ign1, Ign2 and Ign3 are used to activate the associated cascade circuits M1 and M4, M2 and M4, M3 and M4 by applying an appropriate (for example, 5 volts) gate drive to the appropriate IGBT M1, M2, M3. The predriver 30, under the control of the ECU 50, handles the dwell and ignition for each cylinder or channel in turn. The open lead clamping described above enables the IGFET M4 as well as the relevant clamped IGBT M1, M2, M3 to be activated to dissipate an over-voltage.

Figure 2:
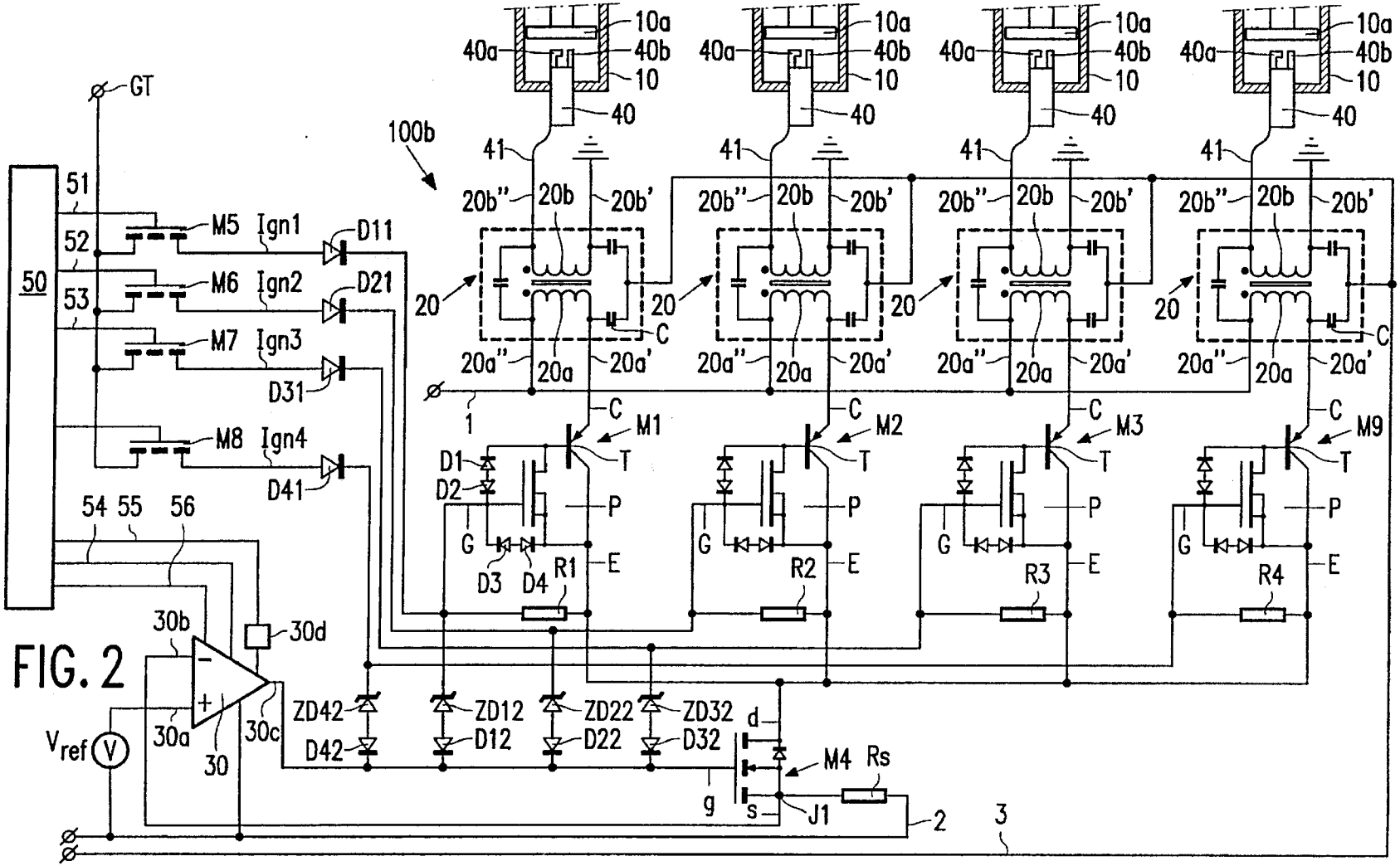
FIG. 2 shows a circuit diagram of another example of an ignition control circuit and engine system, both in accordance with the invention.

FIG. 2 shows a circuit diagram of a second example of an ignition control circuit 100*b* in accordance with the invention.

The ignition control circuit 100*b* shown in FIG. 2 differs from that shown in FIG. 1 in that each cylinder 10 is associated with a separate coil 20. In the example shown in FIG. 2, the internal combustion engine has four cylinders and so four coils 10 are provided which means that an additional IGBT M9 is required. The IGBT M9 is, of course, identical to the other three IGBTs M1 to M3 and is coupled to equivalent components. Thus, the IGBT M9 has a resistor R4 equivalent to the resistor R1 associated with the IGBT M1 coupled between its control electrode G and second main electrode E. A diode D41 (equivalent to the diode D11 associated with the IGBT M1) is coupled to an ignition line Ign4 and via an IGFET M8 (equivalent to the IGFET M5) to an output 57 of the ECU 50. A zener diode ZD42 (equivalent to the zener diode ZD12) is coupled in anti-series with a diode D42 (equivalent to the diode D12) between the ignition line Ign4 and the output 30*c* of the predriver 30.

The circuit 100*b* also differs from the circuit 100*a* shown in FIG. 1 in that, as each coil 20 is associated with only one cylinder, only one terminal 20*b*" of each secondary winding 20*b* is coupled to an outer electrode 40*a* of a spark plug 40. The other terminal 20*b*' of each secondary winding 20*b* is coupled to a suitable ground potential. In practice, the circuit 100*b* functions in a manner similar to the circuit 100*a* except that each coil only generates a spark in a single cylinder and, of course, the timing control of the circuit 100*b* by the ECU 50 will be that appropriate to a four cylinder engine rather than a six cylinder engine.

Of course, the circuits 100*a* and 100*b* shown in FIGS. 1 and 2 could be applied to any engine having four or more cylinders, with the circuit shown in FIG. 1 having one coil 20 for each pair of cylinders 10 and the circuit 100*b* shown in FIG. 2 having a separate coil 20 for each cylinder 10. Thus, the circuit shown in FIG. 1 could be applied to a four cylinder engine in which case only two coils 20 with associated IGBTs would be required and the circuit 100*b* shown in FIG. 2 could be applied to a six cylinder engine in which case six coils 20 and associated IGBTs would be required. In addition, a circuit in accordance with the invention could be applied to an internal combustion engine (such as those used in some motorbikes and cars) in which each cylinder has two separate spark plugs per cylinder to improve combustion spread. In such circumstances, each coil 20 would be coupled to two spark plugs 40 in the manner shown in FIG. 1 but both spark plugs would be in the same cylinder 10.

It is unlikely that the circuit shown in FIG. 1 would be used in a two stroke engine because there is far less scope for firing spark plugs simultaneously in paired cylinders in a two stroke engine because pairing requires the pistons to be at different heights in the two paired cylinders. However, the circuit 100*b* shown in FIG. 2 could also be used for a two stroke engine.

An additional logic output 56' may be included from the predriver 30 to the ECU 50 to indicate whether the predriver 30 has entered current limiting or not. This output 56' from predriver 30 to ECU 50 enables the ECU 50 to monitor this situation and to vary the start (and therefore the duration) of the dwell or on time of the IGFET M4 for each ignition coil so that current limiting is just beginning when the spark is required in a cylinder and long periods of dissipative current limiting are avoided. If the dwell is too long, then there will be a long period of current limiting; while if the dwell is too short, then there will be no current limiting. In practice, however, because the timing of the spark is effectively a precise requirement from the ECU 50 related to crankshaft position and other factors, ideal adaptive dwell may be achieved by the ECU varying the start of the dwell on a trial and error basis in response to the current limit indication output on line 56' from the predriver 30.

More complex adaptive dwell schemes may be used. These may detect when the ignition coil 20 passes through two separate current levels, below the current limiting level, and they may thus enable the ECU 50 to determine the rate of change with time of the current and to extrapolate to find the correct dwell for a given current value. In addition, an indication of sparking may be given to the ECU 50 to assist it in its control of the combustion cycle by using the fact that the current through the primary winding 20*a* and thus through the IGFET M4 and sense resistor Rs falls effectively to zero upon sparking. Such additional detection and control functions are more readily achievable at lower cost in an ignition control circuit in accordance with the invention.

Figure 3:
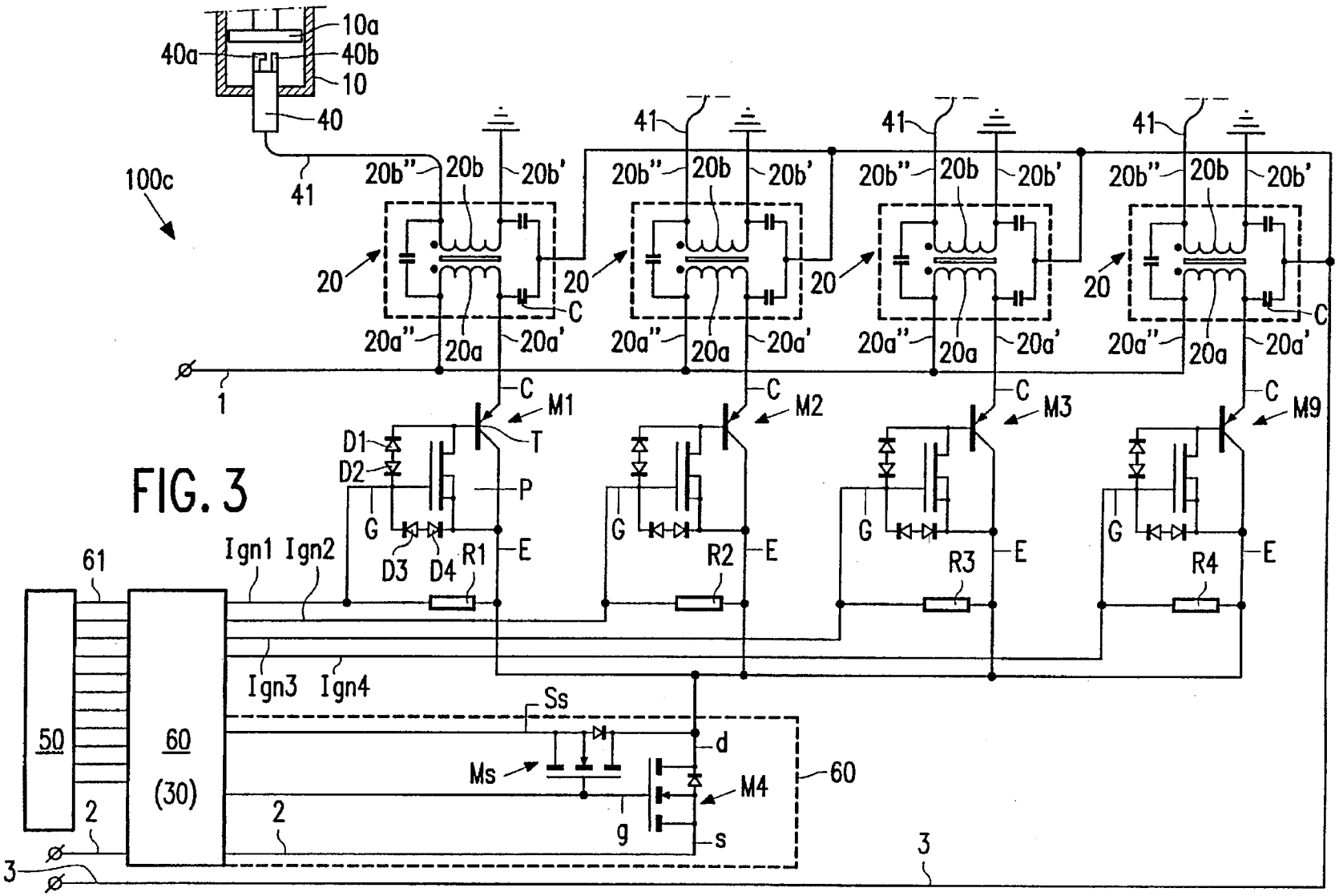
FIG. 3 is a circuit diagram showing a modification of the control circuit in the engine system of FIG. 2, also in accordance with the present invention.

Thus, the further semiconductor device M4 and its control device 30 as provided in accordance with the present invention are common to the power switches M1, M2, M3, M9 of all the ignition coils 20, and this arrangement provides a worthwhile opportunity for integrating extremely sophisticated additional logic functions together with the common circuit device 30. The modification shown in FIG. 3 illustrates an example of such a situation, in which the computer controlled ECU 50 communicates via a two-way data and control bus 61 with a logic and control circuit 60 for determining and controlling various features of the ignition sequence. The provision of one such circuit 60 in common for all the power switches M1, M2, M3, M9 represents a considerable cost reduction, as compared with the provision of similar-function individual circuits for each of the power switches M1, M2, M3, M9 of all the ignition coils 20.

The circuit 60 includes the control functions of devices 30, 30*d* and M5 to M7 of FIGS. 1 and 2. Although FIG. 3 shows the further semiconductor device M4 outside the main circuit block 60, this semiconductor device M4 having a low voltage rating may be integrated in a single monolithic integrated circuit device with the logic and control circuit 60. This is indicated by the broken outline extension of the block 60 in FIG. 3. The diodes D11, D21, D31, D12, D22, D32, ZD12, ZD22, ZD32 may be integrated with the M4 device as described earlier, and/or these diodes may be integrated on and in other device areas of the circuit 60.

In the circuit arrangement of FIG. 3, the current sense means (for sensing the current through the further device M4) may be a resistor Rs outside the main circuit block 60. However the current sense means may be integrated with the device M4 and/or with the circuit block 60. Thus, for example, as illustrated in FIG. 3, the current sense means may be formed by providing the M4 device structure with a sense electrode Ss for deriving a proportion of the current flowing through the device M4, for example in a manner similar to that described in EP-B-0 139 998 or EP-A-0 595 404. In this case the device cells in a small area of M4 may form sense cells of a sense IGFET device Ms having the same drain and gate electrode connections d and g as the main IGFET device M4, but having a separate sense electrode Ss instead of the M4 source electrode s.

The circuit 60 may also comprise additional, more sophisticated logic and control functions, for example for determining and controlling the adaptive dwell time, the actual spark dwell time, and whether or not there is a valid spark. Thus, for example, the circuit 60 may make use of the fact that the current through the primary coil winding 20*a* (and hence also through the common device M4 and its sense means Rs or Ms) falls effectively to zero upon sparking. The circuit 60 may comprise a known type of current and/or voltage level detector which may detect a window of current and/or voltages levels during the rise and fall of these parameters at the beginning and end of each ignition spark. The detection of these levels and/or window can provide a measure of the spark dwell time and whether or not there was a valid spark. This derived data may then be used logically in the circuit 60 to modify as desired the switching of the device M4 (and hence the conduction of the individual coil devices M1, M2, M3, . . . ) for improving the next ignition cycle.

Many other modifications and variations are possible. Thus, a voltage sensing arrangement may be provided to give an indication that there may be a problem, for example an open circuit, in a secondary winding 20*b*. This may be achieved by coupling a resistive divider to the clamping diode chain D1, D2 of each IGBT M1 , M2, . . . to provide to the control circuit 30 or 60 or ECU 50 an indication of an over-voltage to enable, for example, the circuit 30 or 60 to switch on the IGFET M4 to dissipate the over-voltage.

Although the use of IGBTs as described above for the power semiconductor devices is advantageous because an IGBT has a lower on-resistance than the equivalent size power MOSFET, the IGBTs could be replaced with larger size power MOSFETs (which would require lower impedances to drive the larger gate capacitances because of the larger size), or even with power bipolar transistors if an appropriate base drive arrangement is provided.

In the above-described circuits of FIGS. 1 to 3, the low voltage IGFET M4 may be integrated with the predriver 30 and/or control circuit 60, as may the diodes and other logic devices of the circuit to reduce the overall number of components required. Various forms of current sensing means may be used, for example a sense resistor Rs, or for example the further semiconductor device M4 may be provided with a sense electrode Ss for deriving a proportion of the current flowing through sense cells Ms of the further semiconductor device M4 in a manner similar to that described in, for example, EP-B-0139998 or EP-A-0595404. It may also be possible to provide the separate power semiconductor switches M1, M2, . . . with sense cells and to sense the current directly from the current flowing through sense electrodes of the power semiconductor switches. However, where IGBTs are used as the power semiconductor switches M1, M2, . . . , this may require the sense cells to be different from the remaining cells of the IGBT, that is the emitters of the sense cells may be omitted as described in, for example, U.S. Pat. No. 4,980,740 which would mean that the sensed current might not accurately represent the current through the IGBT.

From reading the present disclosure, other modifications and variations will be apparent to persons skilled in the art. Such modifications and variations may involve other features which are already known in the art and which may be used instead of or in addition to features already described herein. Although claims have been formulated in this application to particular combinations of features, it should be understood that the scope of the disclosure of the present application also includes any novel feature or combination of features disclosed herein either explicitly or implicitly, whether or not relating to the same invention as presently claimed in any claim and whether or not it mitigates any or all of the same technical problems as does the presently claimed invention. The applicants hereby give notice that new claims may be formulated to such features and/or combinations of such features during prosecution of the present application or of any further application derived therefrom.

I claim:

1. An ignition control circuit for an internal combustion engine having a plurality of cylinders and at least two ignition coils, each of said coils having a primary and a secondary winding and providing current to no more than two of said cylinders, said ignition control circuit comprising:

a. a respective power semiconductor switch for each of said at least two ignition coils, each of said power semiconductor switches having:

(1) a first main electrode, coupled via the primary winding of the respective ignition coil to a first voltage supply line; and (2) a second main electrode and a control electrode coupled to a respective ignition control line;

said control electrodes enabling the power semiconductor switches to be rendered conducting in a specific sequence;

b. a semiconductor device having first and second main electrodes, coupled between the second main electrodes of the power semiconductor switches and a second voltage supply line, and a control electrode for receiving a drive signal for controlling the current flow through said semiconductor device;

c. current sensing means for sensing the current flowing through the semiconductor device; and d. a control device responsive to the sensed current for controlling the drive signal to limit the current through the semiconductor device to a predetermined value and responsive to an input signal for turning off the semiconductor device to render a conducting one of the power semiconductor switches into a non-conducting state, thereby initiating sparking in one of the cylinders associated with said power semiconductor switch that is rendered into said non-conducting state.

2. An ignition control circuit as in claim 1, wherein the semiconductor device comprises an insulated gate field effect transistor coupled in a cascade configuration with each of the power semiconductor switches.

3. An ignition control circuit as in claim 1 or 2, wherein each of the power semiconductor switches comprises an insulated gate bipolar transistor.

4. An ignition control circuit as in claim 3, wherein each of the insulated gate bipolar transistors is provided with a voltage clamping arrangement for limiting the voltage between the control electrode and the first and second main electrodes of the insulated gate bipolar transistor.

5. An ignition circuit as in claim 1 or 2, wherein the current sensing means comprises a sense resistor coupled between the further semiconductor device and the second voltage supply line.

6. An ignition circuit as in claim 1 or 2, wherein the control device comprises a differential amplifier for comparing a voltage derived from the current sensing means with a reference voltage.

7. An ignition control circuit as in claim 1 wherein each of the ignition control lines, is coupled to the control electrode of a respective one of the power semiconductor switches via a resistive coupling device.

8. An ignition control circuit as in claim 1 wherein each of the ignition control lines is coupled to the control electrode of the semiconductor device by a respective rectifying device.

9. An ignition control circuit as in claim 7 or 8, wherein each of said coupling devices comprises at least one rectifying diode.

10. An ignition control circuit as in claim 1 or 2, wherein the semiconductor device and the control device comprise parts of a common integrated circuit.

11. An engine system comprising an internal combustion engine having a plurality of cylinders and at least two ignition coils, each of said coils having a primary and a secondary winding and providing current to no more than two of said cylinders, and an ignition control circuit comprising:

a. a respective power semiconductor switch for each of said at least two ignition coils, each of said power semiconductor switches having:

(1) a first main electrode coupled via the primary winding of the respective ignition coil to a first voltage supply line; and (2) a second main electrode and a control electrode coupled to a respective ignition control line;

said control electrodes enabling the power semiconductor switches to be rendered conducting in a specific sequence;

b. a semiconductor device having first and second main electrodes coupled between the second main electrodes of the power semiconductor switches and a second voltage supply line and a control electrode for receiving a drive signal for controlling the current flow through said semiconductor device;

c. current sensing means for sensing the current flowing through the semiconductor device; and d. a control device responsive to the sensed current for controlling the drive signal to limit the current through the semiconductor device to a predetermined value and responsive to an input signal for turning off the semiconductor device to render a conducting one of the power semiconductor switches into a non-conducting state, thereby initiating sparking in one of the cylinders associated with said power semiconductor switch that is rendered into said non-conducting state.

* * * * *